US006158440A

United States Patent [19]

Uematsu et al.

[11] Patent Number: 6,158,440

[45] Date of Patent: Dec. 12, 2000

[54] SWOLLEN TOBACCO MATERIAL MANUFACTURING METHOD

[75] Inventors: Hiromi Uematsu; Katsuhiko Kan; Yukio Nakanishi; Kensuke Uchiyama, all of Yokohama, Japan

[73] Assignee: Japan Tobacco, Inc., Tokyo, Japan

[21] Appl. No.: 09/194,365

[22] PCT Filed: Mar. 24, 1998

[86] PCT No.: PCT/JP98/01277

§ 371 Date: Nov. 25, 1998

§ 102(e) Date: Nov. 25, 1998

[87] PCT Pub. No.: WO98/43502

PCT Pub. Date: Oct. 8, 1998

[30] Foreign Application Priority Data

Mar. 27, 1997 [JP] Japan ..... 9-075814

[51] Int. Cl.[7] ..... A24B 3/18

[52] U.S. Cl. ..... 131/291; 131/293; 131/900; 131/902; 131/903

[58] Field of Search ..... 131/291, 293, 131/902, 903, 900

[56] References Cited

U.S. PATENT DOCUMENTS 5,143,096 9/1992 Steinberg ..... 131/291
5,649,552 7/1997 Cho et al. ..... 131/291
5,711,319 1/1998 Cumner ..... 131/291

FOREIGN PATENT DOCUMENTS 50-115169 9/1975 Japan .
55-165793 12/1980 Japan .
5-15360 1/1993 Japan .
5-219928 8/1993 Japan .
6-209752 8/1994 Japan .

*Primary Examiner*—Stanley S. Silverman
*Assistant Examiner*—Jacqueline A. Ruller

[57] ABSTRACT

Disclosed is a method of producing an expanded tobacco material. According to the method, a tobacco material (TM) is fed into a pressure vessel (11), followed by pressurizing the interior of the pressure vessel (11) with a carbon dioxide gas to a predetermined impregnation pressure. Then, a liquid carbon dioxide (21) is supplied from above the tobacco material (TM) into the pressure vessel through a sintered metal plate (13), etc., while maintaining the impregnation pressure, thereby saturating the interior of the pressure vessel (11) with a carbon dioxide gas generated by vaporization of the supplied liquid carbon dioxide, and cooling the tobacco material by the latent heat of vaporization of the liquid carbon dioxide, so as to impregnate the tobacco material with carbon dioxide. The tobacco material impregnated with carbon dioxide is brought into contact with a hot gaseous stream within a gaseous stream dryer so as to expand the tobacco material.

27 Claims, 1 Drawing Sheet

SWOLLEN TOBACCO MATERIAL MANUFACTURING METHOD

This application is the national phase under 35 U.S.C. §371 of prior PCT International Application No. PCT/JP98/01277 which has an International filing date of Mar. 24, 1998 which designated the United States of America.

TECHNICAL FIELD

The present invention relates to a method of producing an expanded tobacco material, and more particularly, to a method of producing an expanded tobacco material by using carbon dioxide as an expanding agent.

BACKGROUND ART

It has been a practice that tobacco materials are expanded in order to save the amount of the tobacco materials used in tobacco articles such as cigarettes, and to moderate the flavor and taste, etc., of the tobacco articles. This expansion is a technique of allowing the dried and shrunk tobacco tissue to be restored to a state close to that of the live tobacco leaf, and constitutes an important technique in the manufacture of tobacco articles.

In principle, the expansion of the tobacco material is effected by allowing an expanding agent to permeate into the tobacco tissue, followed by heating the tobacco material so as to cause the volume of the expanding agent to be expanded, thereby expanding the shrunk tobacco tissue.

As such a method of expanding tobacco material, there is known a method using carbon dioxide as an expanding agent.

For example, Japanese Patent Publication (Kokoku) No. 56-50830 discloses a method wherein a tobacco material is immersed in a liquid carbon dioxide under a pressure of, for example, about 24.6 to 31.6 kg/cm$^2$ to allow the liquid carbon dioxide to be impregnated into the tobacco material, followed by converting the impregnated liquid carbon dioxide into solid carbon dioxide and subsequently evaporating the solid carbon dioxide under high temperatures so as to expand the tobacco tissue. In this method, the entire tobacco material is immersed in the liquid carbon dioxide, with the result that the flavor components of the tobacco material are extracted into the liquid carbon dioxide, lowering the flavor and taste of the expanded tobacco material. Further, a large amount of the liquid carbon dioxide attached to the tobacco material is converted into the solid carbon dioxide, with the result that the tobacco material is solidified and firmly consolidated. The consolidated tobacco material requires a considerably large force to loosen it before the expansion step under heat, resulting in the generation of fine particles unsuitable for the manufacture of cigarettes, leading to a low yield. To overcome this difficulty, it is recommended to drip the liquid carbon dioxide off the tobacco material after the immersion of the tobacco material in the liquid carbon dioxide until the liquid carbon dioxide ceases to form a continuous liquid stream. In this case, however, an additional time is required for dripping off the liquid carbon dioxide, and a satisfactory result cannot still be obtained.

Japanese Patent Publication No. 56-50952 discloses a method wherein carbon dioxide in the form of gas is impregnated into tobacco material, followed by rapidly heating the resultant tobacco material to effect the expansion (expanding). This expansion method using the gaseous carbon dioxide certainly permits avoiding the above-noted difficulty inherent in the technique of using a liquid carbon dioxide described above. However, since only a small amount of carbon dioxide is retained in the tobacco material, the carbon dioxide tends to be escaped off before the step of expanding under heat, resulting in failure to expand sufficiently the tobacco material.

Further, Japanese Patent Disclosure (Kokai) No. 4-228055 and Japanese Patent Disclosure No. 5-219928 disclose a method of expanding the tobacco material, in which the tobacco material is sufficiently cooled in advance to increase the amount of impregnated carbon dioxide by condensing the carbon dioxide gas. More specifically, in the method disclosed in Japanese Patent Disclosure (Kokai) No. 4-228055, the tobacco material is cooled by contacting and mixing it with a misty cold mixture comprising cold gaseous carbon dioxide, carbon dioxide snows, and the like that is formed by, while transferring the tobacco material, supplied in a horizontal mixing tank, within the tank, introducing a liquid carbon dioxide into the mixing tank to expand the liquid carbon dioxide. The cooled tobacco material is introduced into a vertical pressure tank connected to the mixing tank and is brought into contact within the pressure tank with the gaseous carbon dioxide so as to achieve the desired impregnation. In this method, a special apparatus is required for the preliminary cooling. In addition, the heat exchange (heat transmission) state between the misty cold mixture (mainly snows) and the tobacco material tends to take place locally, giving rise to non-uniform tobacco temperature distribution. On the other hand, in the method disclosed in Japanese Patent Disclosure No. 5-219928, the tobacco material is cooled preliminarily by allowing a carbon dioxide gas to flow through the tobacco material. This preliminary cooling necessitates the carbon dioxide gas to circulate within a pressure vessel, making it necessary to use an additional circulating equipment. Further, since the carbon dioxide gas used for cooling the tobacco material has a small sensible heat (specific heat), the tobacco material must be brought into contact with a large amount of the carbon dioxide gas, in this method, in order to cool the tobacco material to a sufficiently low temperature. Further, in these prior art methods, since the cooling efficiency of the tobacco material is low, a large amount of carbon dioxide is required for cooling the tobacco material. In addition, even if the tobacco material is preliminarily cooled, the tobacco material is warmed by the compression heat generated when the carbon dioxide gas is boostered to the impregnation pressure for the impregnation of the carbon dioxide gas within the pressure vessel. It follows that it is necessary to preliminarily cool the tobacco material to a low temperature lower than necessary, which is not economical.

It is an object of the present invention to provide a method of producing an expanded tobacco material, which makes it possible to permit a tobacco material to be impregnated sufficiently with carbon dioxide in a short time using a minimum amount required of carbon dioxide and which also makes it possible to produce a high quality expanded tobacco material having a high expansion rate by using an apparatus of a simple construction.

DISCLOSURE OF INVENTION

The present invention provides a method of expanding a tobacco material by using carbon dioxide, mainly a carbon dioxide gas, in which cooling of the tobacco material by a latent heat of vaporization of a liquid carbon dioxide is utilized in impregnating the tobacco material with carbon dioxide.

The present inventors have conducted an extensive research on the expanding method of a tobacco material using mainly a carbon dioxide gas in an attempt to achieve the above-noted object and have found that, in order to allow the tobacco material to be impregnated sufficiently with carbon dioxide, it is desirable for that portion of carbon dioxide present inside a pressure vessel which is brought into contact with the tobacco material to be in the form of a thin film-like liquid or a misty saturated gas. It has also been found that, in order to achieve the particular state of carbon dioxide, it is effective to cool the tobacco material to the carbon dioxide saturation temperature corresponding to the pressure at which the carbon dioxide is impregnated into the tobacco material (impregnation pressure), and that it is highly effective to utilize for the cooling of the tobacco material the latent heat of vaporization upon the phase change of the liquid carbon dioxide into a carbon dioxide gas, arriving at the present invention.

The present invention utilizes the latent heat of vaporization of a liquid carbon dioxide for cooling the tobacco material contained in a pressure vessel to sufficiently impregnate the tobacco material with carbon dioxide. After the pressure vessel, which contains the tobacco material, is pressurized with a carbon dioxide gas to a desired impregnation pressure, a liquid carbon dioxide is supplied to that tobacco material, while maintaining this impregnation pressure. The supplied liquid carbon dioxide contacts the tobacco material and is vaporized within the pressure vessel so as to saturate the inside of the pressure vessel with the carbon dioxide gas. In this step, the tobacco material is cooled by the latent heat of vaporization of the liquid carbon dioxide to the carbon dioxide saturation temperature corresponding to the impregnating pressure so as to be impregnated sufficiently with the carbon dioxide contained in the atmosphere of the pressure vessel. An expanded tobacco material can be obtained by heating to expand the tobacco material impregnated with the carbon dioxide.

In the present invention, it is possible to stop supplying the liquid carbon dioxide and release or vent the pressure within the pressure vessel (usually, to substantially the atmospheric pressure) as soon as the entire tobacco material contained in the pressure vessel has reached the above-noted saturation temperature. However, it is desirable to release the pressure a predetermined time after the supply of the liquid carbon dioxide is stopped. It is also desirable to set the impregnating pressure at the point at which the liquid carbon dioxide begins to be converted into a solid carbon dioxide, i.e., the pressure not lower than the pressure at the triple point in the carbon dioxide phase diagram (about 4.3 kg/cm$^2$ in gage pressure). Further, the expanding of the tobacco material should desirably be carried out by bringing the tobacco material into contact with a high temperature gaseous stream within a gaseous stream drying machine, followed by separating the expanded tobacco material from the high temperature gaseous stream.

According to one aspect of the present invention, there is provided a method of producing an expanded tobacco material, comprising the steps of:

(a) feeding a tobacco material into a pressure vessel;

(b) pressurizing the inside of the pressure vessel with a carbon dioxide gas to an impregnation pressure of at least about 4.3 kg/cm$^2$ in gage pressure;

(c) supplying a liquid carbon dioxide from above the tobacco material, while maintaining the impregnation pressure, to saturate the inside of the pressure vessel with a carbon dioxide gas by vaporization of the liquid carbon dioxide;

(d) decreasing the pressure within the pressure vessel to substantially atmospheric pressure after a predetermined holding time;

(e) taking the tobacco material out of the pressure vessel;

(f) supplying the tobacco material taken out of the pressure vessel into a gaseous stream drying machine and expanding the tobacco material by bringing the tobacco material into contact with a high temperature gaseous stream within the gaseous stream drying machine; and (g) separating the expanded tobacco material from the high temperature gaseous stream.

According to another aspect of the present invention, there is provided a method of producing an expanded tobacco material, comprising the steps of:

(a) feeding a tobacco material at a first temperature into a pressure vessel;

(b) pressurizing the inside of the pressure vessel with a carbon dioxide gas to an impregnation pressure which is lower than the carbon dioxide gas saturation pressure at the first temperature;

(c) supplying a liquid carbon dioxide from above the tobacco material in the pressure vessel in a minimum amount required for allowing the tobacco material to reach a second temperature corresponding to a saturation temperature of carbon dioxide gas at the impregnation pressure in the pressure vessel to bring the liquid carbon dioxide into contact with the tobacco material and to cool the tobacco material to the second temperature by the latent heat of vaporization of the liquid carbon dioxide, thereby impregnating the tobacco material with carbon dioxide;

(d) taking the tobacco material impregnated with carbon dioxide out of the pressure vessel; and (e) heating to expand the tobacco material taken out of the pressure vessel.

BEST MODE OF CARRYING OUT THE INVENTION

Figure 1:
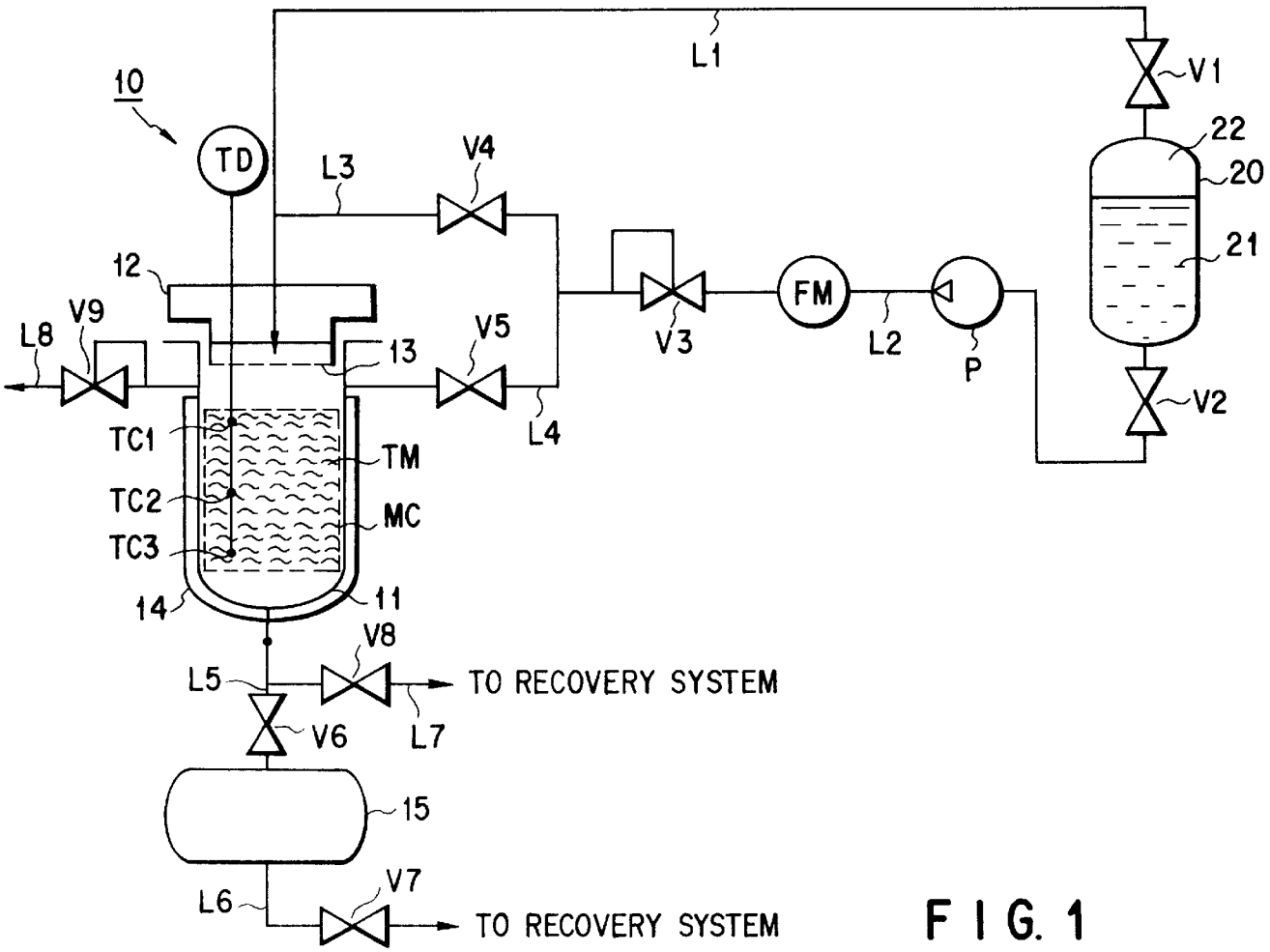
FIG. 1 schematically illustrates an impregnation apparatus used in the method of the present invention for impregnating a tobacco material with carbon dioxide.

The present invention will be described in more detail below.

According to the present invention, a tobacco material is first put into a pressure vessel (impregnating vessel).

The tobacco material is generally in the form of shredded tobacco or small laminae, and various kinds of tobacco materials can be used.

The water content of the tobacco material should desirably be 12 to 33% by weight, preferably 12 to 25% by dry weight, on dry weight basis. The temperature of the tobacco material at the time when the tobacco material is put into the pressure vessel (initial tobacco temperature) is generally set at 20 to 30° C., which is substantially equal to the room temperature within the cigarette producing factory by the temperature control of the factory, and thus the tobacco material is put into the pressure vessel at that temperature. Needless to say, it is possible to use tobacco materials having an initial tobacco temperature lower than or higher than the above-noted temperature.

Next, the air within the pressure vessel containing the tobacco material is purged, as is conventionally conducted. The purging can be carried out by either introducing a carbon dioxide gas into the pressure vessel or by decompressing the inside of the pressure vessel by using a vacuum pump.

After the purging step, the inside of the pressure vessel containing the tobacco material is pressurized with a carbon dioxide gas to a desired impregnation pressure. It is desirable for the impregnation pressure not to be lower than the point at which the liquid carbon dioxide begins to be converted into a solid carbon dioxide, i.e., the pressure at the triple point in the carbon dioxide phase diagram (about 4.3 $kg/cm^2$ in gage pressure). By so setting the impregnation pressure not to be lower than the pressure at the triple point in the carbon dioxide phase diagram, the likelihood can be diminished that the liquid carbon dioxide supplied in the subsequent step is converted into a solid carbon dioxide so as to be adhered to the wall of the pressure vessel and to clog the piping of the pressure vessel.

In the present invention, the latent heat of vaporization of a liquid carbon dioxide is utilized for cooling the tobacco material. Therefore, more strictly, the impregnation pressure is defined as a pressure lower than the saturation pressure of a carbon dioxide gas at the initial tobacco temperature (e.g., 20 to 30° C.) of the tobacco material contained in the pressure vessel.

It is desirable for the impregnation pressure not to be lower than 10 $kg/cm^2$ (gage pressure) at which the saturation temperature of a carbon dioxide gas is about −37° C., in view of the brittleness of the tobacco material at low temperatures, an economy including facilities for maintaining the impregnation system at low temperatures, etc.

In order to achieve a high expanding rate of the tobacco material, the impregnation pressure should desirably be as high as possible. However, carbon dioxide has a critical point at relatively low pressure and temperature (74.2 $kg/cm^2$ (gage pressure) and 31.1° C.). Under the pressure and temperature higher than the critical point, carbon dioxide is incapable maintaining a liquid phase, with the result that the control system is rendered complex and it is impossible to achieve further improvement in the expanding rate. Such being the situation, practically, the impregnation pressure should not exceed that pressure, usually about 74 $kg/cm^2$ in gage pressure (carbon dioxide gas saturation temperature of 31° C.).

On the other hand, if the impregnation pressure is low, the mechanical strength required for the pressure vessel may be low, leading to the cost saving of the pressure vessel.

Under the circumstances, the practical impregnation pressure is determined in view of the desired expanding rate of the tobacco material, the amount of the liquid carbon dioxide used (which will be described herein later), the mechanical strength of the pressure vessel, operability, etc. Usually, in view of the initial tobacco temperature of the tobacco material being 20 to 30° C., the impregnation pressure of 30 to 60 $kg/cm^2$ (gage pressure) is used conveniently.

After the carbon dioxide gas is introduced into the pressure vessel to the impregnation pressure as described above, a liquid carbon dioxide is supplied from above the tobacco material while maintaining the impregnation pressure.

The liquid carbon dioxide can be supplied through one or more spray nozzles arranged below an upper lid of the pressure vessel, through a sintered metal plate having pores sized 2 to 200 $\mu$m in diameter and arranged blow the upper lid of the pressure vessel in a manner to cross the opening of the pressure vessel, or through a spray nozzle arranged in the circumferential wall of the pressure vessel in the vicinity of the open end of the pressure vessel. It is also possible to use other suitable means for supplying a liquid carbon dioxide into the pressure vessel.

The amount of the liquid carbon dioxide to be supplied can be defined as a minimum amount required for the temperature of the tobacco material contained in the pressure vessel to reach a temperature corresponding to the temperature of the saturated carbon dioxide gas at the impregnation pressure described above.

For example, the initial tobacco temperature of the tobacco material is usually 20 to 30° C., as described previously, and the saturation pressure of the carbon dioxide gas at this temperature level is about 57 to 72 $kg/cm^2$. If the impregnation pressure is set at a level lower than the saturation pressure of a carbon dioxide gas at the initial tobacco temperature of the tobacco material, the liquid carbon dioxide supplied into the pressure vessel containing the tobacco material is brought into contact with the tobacco material so as to be vaporized. Thus, the tobacco material is cooled by the latent heat of vaporization of the liquid carbon dioxide. It follows that, if a controlled amount of a liquid carbon dioxide is supplied into the pressure vessel, all the liquid carbon dioxide is vaporized to saturation within the pressure vessel, with the result that the temperature of the tobacco material becomes equal to the saturation temperature of the carbon dioxide gas at the impregnation pressure. The vaporization of the liquid carbon dioxide causes the inner pressure of the pressure vessel to be increased. However, the impregnation pressure can be maintained within the pressure vessel without difficulty by operating a pressure-retaining means well known to those skilled in the art such as a pressure-retaining valve which is attached to the pressure vessel.

There will now be described how to determine the supply amount of a liquid carbon dioxide, covering the case where, for example, a tobacco material (shredded tobacco) having an initial tobacco temperature of 25° C. and containing 25% by weight of water (dry weight basis) is used, and the impregnation pressure is set at 30 $kg/cm^2$ in gage pressure.

(1) First, a calorie required for cooling the shredded tobacco material having a temperature of 25° C. to a saturation temperature of a carbon dioxide gas (−4.5° C.) at the impregnation pressure of 30 $kg/cm^2$ (gage pressure) is determined as follows:

(a) The specific heat of a shredded tobacco material, though slightly varying depending on the kind of the raw material and on the water content of the tobacco, can generally be considered to be the sum of the calorie of the water content represented on dry basis added to the specific heat of a dry tobacco material (0.34 kcal/kg° C.). Therefore, the specific heat of the shredded tobacco material containing 25% of water (0.25 kg $H_2O$/kg shredded tobacco material) is about 0.6 kcal/kg° C.

(b) The calorie required for cooling 1 kg (dry weight) of the shredded tobacco material=about 18 kcal/kg can be obtained by multiplying the value noted above by the cooling temperature {25° C.−(−4.5° C.)=29.5° C.}.

(2) On the other hand, the latent heats of vaporization of a liquid carbon dioxide are described in a scientific literature such as "International Unit for Pure and Applied Chemistry" published by Pargamon Press Inc. or a collection of thermophysical values published by Japan Machinery Institute, and the latent heat of vaporization of a liquid carbon dioxide at a gage pressure of 30 $kg/cm^2$ is about 60 kcal/kg.

(3) It follows that the amount of a liquid carbon dioxide required for cooling the shredded tobacco material can be obtained by dividing the calorie of about 18 kcal/kg required for cooling the shredded tobacco material by the latent heat of vaporization of about 60 kcal/kg for the liquid carbon dioxide. In other words, it may suffice to supply 0.29 kg of a liquid carbon dioxide for cooling 1 kg (dry weight basis) of the shredded tobacco material.

However, practically, it is desirable to supply a liquid carbon dioxide in an amount somewhat larger than the calculated amount (theoretical amount) in view of influences by the heat intruding into the pressure vessel system from outside the system and the state in terms of the pressure and temperature of the liquid carbon dioxide to be supplied. To be more specific, it is preferable to supply a liquid carbon dioxide in an amount about 1 to about 7 times, more preferably 1.5 to 4 times, as large as the theoretical amount noted above.

In terms of the amount of the liquid carbon dioxide relative to the weight of the tobacco material, the liquid carbon dioxide should preferably be supplied in an amount of about 0.04 to 2.4 times, more preferably about 0.06 to 1.4 times, as much as the dry weight of the tobacco material. This amount is appropriate particularly where the tobacco material contains 12 to 25% by weight of water on the dry weight basis of the tobacco material and has an initial tobacco temperature of 20 to 30° C., and the impregnation pressure is set at 30 to 60 kg/cm$^2$ in gage pressure. The supply amount of carbon dioxide can be diminished with increase in the impregnation pressure.

In this way, the tobacco material is cooled by the latent heat of vaporization of the supplied liquid carbon dioxide to the saturation temperature of the carbon dioxide gas at the impregnation pressure, and the tobacco material is sufficiently impregnated with carbon dioxide.

Where the supply amount of the liquid carbon dioxide is insufficient, all the liquid carbon dioxide supplied is vaporized to a dry gas state. In this case, the temperature of the tobacco material is not lowered to reach the saturation temperature noted above, and thus an additional liquid carbon dioxide should be supplied. The particular state can be detected by a temperature sensor mounted in contact with the tobacco material. On the other hand, where an excessive amount of a liquid carbon dioxide is supplied, the liquid carbon dioxide partly remains in a liquid state. The remaining liquid carbon dioxide is collected at the bottom of the pressure vessel by the gravity and may be recovered. The particular state can be monitored through an observation window formed at a bottom portion of the pressure vessel.

The fact that the carbon dioxide inside the pressure vessel has reached the saturated state can be confirmed by a temperature sensor, mounted at, for example, the lowermost portion of the tobacco material or at the outlet port (recovery pipe) in the bottom portion of the pressure vessel, indicating the saturation temperature. Alternatively, it is reasonable to understand that the saturated state has been reached at the time when the presence of even a slight amount of a liquid carbon dioxide at the bottom portion of the pressure vessel has been recognized through the observation window.

Thereafter, the supply of the liquid carbon dioxide is stopped, followed by venting the pressure vessel to substantially the atmospheric pressure. Then, the tobacco material impregnated with carbon dioxide is taken out of the pressure vessel, and is transferred to an heat-expanding step so as to expand the tobacco material under heat.

The tobacco material as taken out of the pressure vessel retains the inner shape of the pressure vessel imparted by influence of the impregnating operation in some cases. Even in this case, the tobacco material is not consolidated and solidified, and is in a state wherein it can be readily collapsed if the tobacco material is lightly grasped by hands. In such a case, it is convenient to pass the tobacco material through a pair of rollers each having a plurality of pins mounted thereto so as to loosen the tobacco material. The tobacco material is not broken (i.e., does not generate waste, fine particles, etc) by the loosening treatment. It follows that the tobacco material impregnated with carbon dioxide by the method of the present invention can be transferred to the heat-expanding step without being broken.

In the heat-expanding step, the tobacco material impregnated with carbon dioxide is generally brought into contact with a high-temperature gas stream within a gas stream dryer. As widely known in the art, the gas stream dryer is constructed such that a high-temperature gas stream flows at a high speed within an expanding pipe consisting in general of a stainless steel pipe. The hot gas stream generally contains a major amount of a water vapor.

In the heat-expanding step, the expanding speed of carbon dioxide within the tobacco tissue is increased with increase in the heating temperature, leading to a high expansion ratio. In the present invention, however, the tobacco material after impregnation with carbon dioxide has no or almost no solid carbon dioxide attached thereto. It follows that a desired expansion ratio can be achieved even if the expanding temperature is relatively low. At any rate, a rapid heating is desirable for the expanding of the tobacco material. Further, it is desirable to dry the tobacco material to lower the water content to, for example, 8% (dry weight basis) in order to once fix the expanded tobacco tissue. The gas stream dryer is adapted for achieving the rapid heating. The heating temperature and time can be determined in view of the desired expansion ratio and the smoking flavor and taste (e.g., absence of a burning smell). In the present invention, a high expansion ratio can be achieved by bringing the tobacco material into contact with a hot gas stream of about 260° C. to 350° C. for only 1 to 2 seconds.

Following the expansion, the expanded tobacco material is separated from the hot gas. As widely known in the art, the separation can be achieved by a tangential separator connected to the gas stream dryer.

Incidentally, it is possible that, after the liquid carbon dioxide is introduced into a pressure vessel and the pressure vessel reaches the saturated state, the state within the pressure vessel is maintained or held for a certain period of time in order to more ensure the impregnation of carbon dioxide into the tobacco material, without immediately venting the pressure. The maintaining or holding time is preferably 10 seconds or more, and the holding time of up to about 20 minutes is sufficient. The holding time may be longer, as the impregnation pressure is lower, while it may be shorter, as the impregnation pressure is higher.

The present inventors have further found that the impregnation pressure is related to the initial water content of the tobacco material. Specifically, it has been found that the initial water content of the tobacco material required for achieving the highest range of expanding ratios (hereinafter referred to as the appropriate initial water content) may be lower, as the impregnation pressure is higher, as evidenced by the Examples described herein later. For example, where the impregnation pressure is 30 kg/cm$^2$ in gage pressure, the highest range of expanding ratios can be achieved by setting the initial water content of the tobacco material at 20 to 25% (dry weight basis). Where the impregnation pressure is 40 kg/cm$^2$ in gage pressure, the highest range of expanding ratios can be achieved by setting the initial water content of the tobacco material at 18 to 23% (dry weight basis). Further, where the impregnation pressure is 50 kg/cm$^2$ in gage pressure, the highest range of expanding ratios can be achieved by setting the initial water content of the tobacco material at 16 to 21% (dry weight basis).

The appropriate initial water content, which is somewhat dependent on the kinds of the tobacco materials, classification of the tobacco leaves, etc., falls within the water content range noted above, particularly in the case of using a cut tobacco blend having various kinds of tobacco materials mixed therein.

It should also be noted that, in the case of using a tobacco material having the appropriate initial water content, the higher expanding ratio can be achieved with increase in the impregnation pressure.

Another advantage of the impregnation pressure being high is that the minimum required amount of the liquid carbon dioxide used can be decreased, and that solidification/consolidation of the tobacco material after impregnation can be prevented more effectively. To be more specific, the saturation temperature of carbon dioxide gas, which is about −4.5° C. under the gage pressure of 30 kg/cm$^2$, is as high as about +14.5° C. under the gage pressure of 50 kg/cm$^2$. It follows that the calorie required for cooling a tobacco material at the initial tobacco temperature of 20–30° C. to the saturation temperature (and hence the amount of liquid carbon dioxide) can be diminished with increase in the impregnation pressure. In addition, the appropriate initial water content of the tobacco material tends to be lowered with increase in the impregnation pressure, as already pointed out. It follows that the sensible heat corresponding to the water content of the tobacco material is also diminished, leading to a further reduction in the calorie (and hence the amount of liquid carbon dioxide) required for the cooling. In conclusion, the higher impregnation pressure permits decreasing the amount of the liquid carbon dioxide used, and increasing the temperature reached by the tobacco material during the impregnation (saturation temperature of the carbon dioxide gas), thereby lowering the appropriate water content of the tobacco material. It follows that solidification/consolidation of the tobacco material can be prevented further more effectively.

Tables 1 to 4 below show the relationship among the initial water content of the tobacco material (dry weight basis), the initial temperature of the tobacco material, and the required minimum amount of a liquid carbon dioxide (calculated value relative to 1 kg (dry weight basis) of the tobacco material, covering the cases where the impregnation pressure is 30 kg/cm$^2$ in gage pressure (saturation temperature of −4.5° C., and the latent heat of vaporization of the liquid carbon dioxide of 60 kcal/kg), where the impregnation pressure is 40 kg/cm$^2$ in gage pressure (saturation temperature of +6.3° C., and the latent heat of vaporization of the liquid carbon dioxide of 50 kcal/kg), where the impregnation pressure is 50 kg/cm$^2$ in gage pressure (saturation temperature of +14.5° C., and the latent heat of vaporization of the liquid carbon dioxide of 43 kcal/kg), and where the impregnation pressure is 60 kg/cm$^2$ in gage pressure (saturation temperature of +22.0° C., and the latent heat of vaporization of the liquid carbon dioxide of 34 kcal/kg). In each of Tables 1 to 4, the initial water content of the tobacco material which achieves the highest expanding ratios under the respective impregnation pressure is given as the appropriate water content.

Table 1: The minimum required amount (kg) of a liquid carbon dioxide per kg of the tobacco material under the impregnation pressure of 30 kg/cm$^2$ (gage pressure)

| Initial Water Content of Tobacco | Initial Tobacco Temperature of Tobacco Material | | |
|---|---|---|---|
| Material | 20° C. | 25° C. | 30° C. |
| 12% | 0.19 | 0.23 | 0.26 |
| 14% | 0.20 | 0.24 | 0.28 |
| 16% | 0.20 | 0.25 | 0.29 |
| 18% | 0.21 | 0.26 | 0.30 |
| 20% | 0.22 | 0.27 | 0.31 |
| 22% | 0.23 | 0.28 | 0.32 |
| 24% (Appropriate water content) | 0.24 | 0.29 | 0.33 |
| 25% | 0.24 | 0.29 | 0.34 |

Table 2: The minimum required amount (kg) of a liquid carbon dioxide per kg of the tobacco material under the impregnation pressure of 40 kg/cm$^2$ (gage pressure)

| Initial Water Content of Tobacco | Initial Tobacco Temperature of Tobacco Material | | |
|---|---|---|---|
| Material | 20° C. | 25° C. | 30° C. |
| 12% | 0.13 | 0.17 | 0.22 |
| 14% | 0.13 | 0.18 | 0.23 |
| 16% | 0.14 | 0.19 | 0.24 |
| 18% | 0.14 | 0.19 | 0.25 |
| 20% (Appropriate water content) | 0.15 | 0.20 | 0.26 |
| 22% | 0.15 | 0.21 | 0.27 |
| 24% | 0.16 | 0.22 | 0.27 |
| 25% | 0.16 | 0.22 | 0.28 |

Table 3: The minimum required amount (kg) of a liquid carbon dioxide per kg of the tobacco material under the impregnation pressure of 50 kg/cm$^2$ (gage pressure)

| Initial Water Content of Tobacco | Initial Tobacco Temperature of Tobacco Material | | |
|---|---|---|---|
| Material | 20° C. | 25° C. | 30° C. |
| 12% | 0.06 | 0.11 | 0.17 |
| 14% | 0.06 | 0.12 | 0.17 |
| 16% | 0.06 | 0.12 | 0.18 |
| 18% (Appropriate water content) | 0.07 | 0.13 | 0.19 |
| 20% | 0.07 | 0.13 | 0.19 |
| 22% | 0.07 | 0.14 | 0.20 |
| 24% | 0.07 | 0.14 | 0.21 |
| 25% | 0.08 | 0.14 | 0.21 |

Table 4: The minimum required amount (kg) of a liquid carbon dioxide per kg of the tobacco material under the impregnation pressure of 60 kg/cm$^2$ (gage pressure)

| Initial Water Content of Tobacco Material | Initial Tobacco Temperature of Tobacco Material | |
|---|---|---|
| | 25° C. | 30° C. |
| 12% | 0.04 | 0.11 |
| 14% | 0.04 | 0.11 |
| 16% (Appropriate water content) | 0.04 | 0.12 |
| 18% | 0.05 | 0.12 |
| 20% | 0.05 | 0.13 |
| 22% | 0.05 | 0.13 |
| 24% | 0.05 | 0.14 |
| 25% | 0.05 | 0.14 |

FIG. 1 schematically shows as an example of an impregnation apparatus 10 for impregnating a tobacco material with carbon dioxide in the method of the present invention. The impregnation apparatus 10 comprises a pressure vessel (impregnation vessel) 11 for housing a metal mesh container MC in which a tobacco material TM is contained. The pressure vessel 11, which is made of, for example, a stainless steel, has a cylindrical body. An upper lid 12 is detachably mounted to the upper open end of the pressure vessel 11 so as to hermetically close the pressure vessel 11.

A liquid carbon dioxide spraying member 13 made of a porous sintered metal plate having pores sized at 2 to 200 $\mu$m in diameter is arranged below and apart from the lower surface of the upper lid 12. The spraying member 13 has a planar shape equal to the inner cross sectional planar shape of the pressure vessel 11 and is arranged to cross the open cross section of the pressure vessel 11 when the pressure vessel 11 is hermetically closed by the upper lid 12.

The outer circumferential surface of the pressure vessel 11 is covered with a jacket 14 so as to prevent the external heat from invading into the pressure vessel and, thus, to maintain the impregnation pressure within the pressure vessel 11 or to maintain the saturation temperature of the carbon dioxide gas within the pressure vessel 11. It is possible to circulate within the jacket 14 a cooling medium or a heating medium required for maintaining the saturation temperature noted above.

A reservoir 20 storing a liquid carbon dioxide is arranged outside the pressure vessel 11. The free space above the liquid carbon dioxide 21 within the reservoir 20 is filled with a carbon dioxide gas 22.

To supply the carbon dioxide gas 22 into the pressure vessel 11, a line L1 is arranged which communicates at one end portion with the inner space of the pressure vessel 11 through the upper lid 12 and also communicates at the other end portion with the free space in the upper portion of the reservoir 20. An opening/closing valve V1 is mounted to the line L1 in the vicinity of the upper end of the pressure vessel 11. The supply into the pressure vessel 11 and the stoppage of the supply of the carbon dioxide gas 22 are controlled by the opening and closing operation of the valve V1, respectively.

A line L2 is arranged which communicates with the bottom portion of the reservoir 20 for supplying the liquid carbon dioxide 21 into the pressure vessel 11. Mounted to the liquid carbon dioxide supply line L2 are an opening/closing valve V2, a liquid carbon dioxide supply pump P, a flow meter FM, and a pressure reducing valve V3 in the order mentioned as viewed from the reservoir 20. If the supply pump P is driven with the valve V2 opened, the liquid carbon dioxide 21 within the reservoir 20 flows toward the pressure vessel 11. The flow meter FM measures the flow rate of the liquid carbon dioxide, and generates a signal for stopping the operation of the supply pump P when the amount of the liquid carbon dioxide flowing through the flow meter FM has reached a predetermined integrated value. The supply pump P can be stopped in response to the signal. The pressure reducing valve V3 serves to control the liquid carbon dioxide 21 supplied through the line L2 into the pressure vessel 11 at a predetermined pressure.

The line L2 is branched into two lines L3 and L4 on the downstream side of the pressure reducing valve V3. The branched line L3 is combined with the line L1 outside the pressure vessel 11. The other branched line L4 is connected to spray nozzles (not shown) arranged at an upper peripheral portion of the pressure vessel 11, extending into the interior of the pressure vessel 11.

The liquid carbon dioxide supplied through the line L3 passes through the pores of the sintered metal plate 13 so as to be sprayed onto the tobacco material TM. On the other hand, the liquid carbon dioxide supplied through the line L4 is sprayed through the spray nozzles noted above onto the tobacco material TM. The supplies of the liquid carbon dioxide through the lines L3 and L4 may be made simultaneously, or appropriately switched. For this purpose, opening/closing valves V4 and V5 are mounted to the lines L3 and L4, respectively. Incidentally, it is possible to supply the liquid carbon dioxide through only one of the lines L3 and L4, making it possible to omit any one of these lines L3 and L4. In this case, it is of course unnecessary to keep the valve (V4 or V5) mounted to the remaining line (line L3 or L4). It should also be noted that a disc provided with a plurality of spray nozzles can be used in place of the sintered metal plate 13. In this case, the liquid carbon dioxide supplied through the line L3 may be sprayed through these spray nozzles.

Temperature measuring means, e.g., thermocouples TC1, TC2 and TC3 are mounted in the upper portion, intermediate portion and lower portion, respectively, of the tobacco material TM housed in the pressure vessel 11. The temperatures measured by these thermocouples are detected by a temperature detector TD arranged outside the pressure vessel 11.

A liquid carbon dioxide recovery tank 15 is arranged below the pressure vessel 11, which tank, where the liquid carbon dioxide supplied into the pressure vessel 11 flows out slightly through the tobacco material TM, receives the said liquid carbon dioxide through a line L5 having an opening/closing valve V6 mounted thereto. The liquid carbon dioxide received by the recovery tank 15 flows through a line L6 having an opening/closing valve V7 mounted thereto so as to be brought back to the reservoir 20 through recovery and purification steps conducted in a recovery facility (not shown). Also, a pressure release line L7 having an opening/closing valve V8 mounted thereto is connected to the line L5 upstream of the valve V6. If the valve V8 is opened, the pressure within the pressure vessel 11 is released so as to lower the inner pressure of the pressure vessel 11 to substantially atmospheric pressure. The carbon dioxide gas released through the pressure releasing valve V8 and the line L7 is forwarded into a recovery facility (not shown).

Further, a line L8 communicating with the inner space of the pressure vessel 11 and having a pressure retaining valve V9 mounted thereto is arranged in an upper portion of the pressure vessel 11. The pressure retaining valve V9 serves to control the carbon dioxide gas pressure within the pressure vessel 11 not to exceed a predetermined impregnation pressure, and can adjust the impregnation pressure with a satisfactory accuracy in cooperation with the pressure reducing valve 3. Incidentally, the carbon dioxide gas discharged through the pressure retaining valve V9 and the line L8 is also forwarded into the recovering facility (not shown).

In order to impregnate the tobacco material with carbon dioxide by using the impregnation apparatus 10, the metal mesh container MC housing the tobacco material TM is put in the pressure vessel 11. Then, the upper lid 12 is closed. Also, the valves V1 and V8 are opened so as to permit a carbon dioxide gas to be introduced into the pressure vessel 11 for a short time, thereby to purge the interior of the pressure vessel 11.

Then, the valve V8 is closed so as to pressurize the carbon dioxide gas within the pressure vessel 11 to a desired impregnation pressure. After completion of the pressurizing operation, the valves V1 and V2 are closed and opened, respectively. At the same time, the valve V4 and/or valve V5 are opened so as to permit the liquid carbon dioxide to be sprayed from above the tobacco material TM. Immediately after all the thermocouples TC1 to TC3 indicate the saturation temperature of the carbon dioxide gas at the impregnation pressure, the valve V2 and further the valve V4 and/or the valve V5 are closed so as to stop supplying the liquid carbon dioxide. Then, immediately or a predetermined holding time after stopping of the liquid carbon dioxide supply, the pressure releasing valve V8 is opened so as to release the pressure within the pressure vessel 11 to substantially atmospheric pressure. Thereafter, the upper lid 12 is opened and the tobacco material impregnated with carbon dioxide is taken out of the pressure vessel 11. Further, the impregnated tobacco material is put in a gas stream dryer (not shown) so as to apply a predetermined expanding treatment under heat to the tobacco material.

As described above, the impregnation apparatus 10 does not necessitate a separate apparatus for the preliminary cooling of the tobacco material and has a simple construction that can be achieved by mounting a liquid carbon dioxide spraying means to a pressure vessel. In the present invention, an expanded tobacco having a high expanding ratio (volume expansion ratio) can be obtained after the expanding treatment by using the impregnation apparatus of the simple construction for impregnating the tobacco material with carbon dioxide.

There will now be described below Examples of the present invention together with Comparative Examples. The apparatus used for the carbon dioxide impregnation in the following Examples is equal in construction to the carbon dioxide impregnation apparatus shown in FIG. 1. The sintered metal plate 13 alone was used in the Examples of the present invention for spraying a liquid carbon dioxide. The impregnation apparatus was operated as already described with reference to FIG. 1. The pressure referred to in the following Examples and Comparative Examples represents the gage pressure.

The terms used in the following Examples and Comparative Examples are defined as follows:

Water Content: The amount of water content is the weight reduced after a sample of the tobacco material is kept housed for one hour in an natural convection oven at 100° C. The water content is the proportion of the amount of water relative to the dry weight of the tobacco material. This definition of the water content applies throughout the present specification.

Volume Expansion Ratio: The volume expansion ratio represents the loading capacity of a tobacco material in the case of producing cigarettes. It is defined as follows by using a DD60A type densimeter manufactured by Borgwaldt GmbH in Germany.

(1) A sample of a tobacco material is loaded in a cylindrical container (cylinder) having a diameter of 60 mm. A sample before the expanding treatment is used in an amount of 15 g. Also, a sample after the expanding treatment is used in an amount of 10 g after its humidity is re-adjusted again.

(2) The loaded tobacco material is compressed for 30 seconds with a piston having a diameter of 56 mm and having 3 kg of load applied thereto.

(3) Since the height of the compressed tobacco material layer is indicated, the apparent volume of the tobacco material is obtained from the indicated value. The value obtained by dividing the apparent volume by the weight of the tobacco material represents the volume expansion ratio (in unit of cc/g).

The larger the value of volume expansion ratio, the higher the loading capacity of the tobacco material, and hence the smaller the weight of the tobacco material loaded per cigarette.

Improvement of Volume Expansion Ratio:
The improvement of volume expansion ratio represents the value obtained by dividing the volume expansion ratio of the tobacco material after the expanding treatment by the volume expansion ratio of the tobacco material before the expanding treatment. The larger this value, the more the loading capacity is increased.

$CO_2$ Retaining Rate: The weight of the sample is measured both before and after the impregnation with carbon dioxide, and the increment in the weight denotes the carbon dioxide ($CO_2$) retaining amount. The $CO_2$ retaining rate represents the value obtained by dividing the $CO_2$ retaining amount by the weight of the sample before the impregnation (dry weight).

Humidity Re-adjustment: The water content of the expanded tobacco material is adjusted to be appropriate for preparing cigarettes. The particular operation is called humidity re-adjustment. The humidity re-adjustment was carried out by storing the expanded tobacco material in a room having a temperature of 22° C. and a relative humidity of 60% for one week.

Tasting Quality: This is the results of an organoleptic evaluation of the smoking taste conducted by 10 panelists who had been specially trained in judging the flavor, taste, etc., of tobacco. Specifically, each panelist evaluated the tasting quality in 7 stages of −3, −2, −1, 0, +1, +2 and +3, and the average of the valuations by the 10 panelists was used as the tasting quality. The evaluation "0" represents the standard tasting quality. The symbol "+" put before the value of evaluation indicates a high tasting quality, with the symbol "−" put before the value of evaluation indicating a low tasting quality. Thus, the evaluation "+3" indicates the highest tasting quality. Likewise, the evaluation "−3" indicates the lowest tasting quality.

EXAMPLE 1

Water was sprayed onto a typical blended cut tobacco material (symbol: B−3) to humidify the tobacco material, thereby to prepare five kinds of samples differing from each other in the initial water content, as shown in Table 5.

At least 5 hours after the humidification, each of the cut tobacco material samples (about 100 g by dry weight) was put in a metal mesh container made of stainless steel, followed by putting the metal mesh container in a pressure vessel (an inner volume of 1 L (liter), a diameter of 80 mm and a depth of 200 mm). Then, the pressure vessel was purged with a carbon dioxide gas for 10 seconds.

Thereafter, a carbon dioxide gas was introduced into the pressure vessel to pressurize the interior of the pressure vessel to an impregnation pressure of 30, 40 or 50 kg/cm$^2$.

After the supply of the carbon dioxide gas was stopped, the supply of a liquid carbon dioxide from an upper portion of the pressure vessel was started. The liquid carbon dioxide was gradually sprayed until all the thermocouples TC1, TC2 and TC3 positioned in the upper portion, the intermediate portion and the lower portion, respectively, of the cut tobacco material layer indicated the saturation temperature of the carbon dioxide gas at the impregnation pressure.

At almost the same time as when the lower thermocouple TC3 indicated the saturation temperature, a liquid carbon dioxide was found to drip only slightly from the bottom portion of the pressure vessel. At this time, the supply of the liquid carbon dioxide was stopped.

One minute after the supply of the liquid carbon dioxide was stopped, the pressure within the pressure vessel was released over about 10 seconds to atmospheric pressure and, then, the cut tobacco material impregnated with carbon dioxide was taken out of the pressure vessel.

This sample was put in a gas stream dryer so as to effect a heat-expanding treatment. The gas stream dryer consisted of a stainless steel pipe (expanding pipe) having an inner diameter of 84.9 mm and a length of 12 m, wherein a hot gas stream containing 80% by volume of steam was flowed at a flow rate of 38 m/sec. The inlet temperature of the gas stream dryer was controlled at 350° C. The cut tobacco material passed through the expanding pipe in about one second. The expanded cut tobacco material, which passed through the expanding pipe, was separated from the gas stream by a tangential separator and recovered. The tobacco material thus obtained was found to contain 3 to 4% of water.

After the humidity of each cut tobacco material was re-adjusted, the volume expansion ratio, the improvement of the volume expansion ratio and the $CO_2$ retaining rate were measured. The results are shown in Table 5.

TABLE 5

| Impregnation Pressure [kg/cm$^2$] | Initial Water Content [%] | Volume Expansion Ratio [cc/g] | Improvement of Volume Expansion Ratio | $CO_2$ Retaining Rate [%] |
|---|---|---|---|---|
| 0 (not impregnated) | 14.6 | 4.10 | 1.00 | 0 |
| 30 | 15.6 | 8.56 | 2.09 | 14.4 |
| | 18.4 | 8.88 | 2.17 | 12.0 |
| | 20.9 | 9.03 | 2.20 | 8.5 |
| | 23.5 | 9.40 | 2.29 | 7.1 |
| | 27.4 | 8.69 | 2.12 | 6.3 |
| 40 | 15.6 | 9.16 | 2.23 | 6.6 |
| | 18.4 | 9.64 | 2.35 | 5.4 |
| | 20.9 | 9.72 | 2.37 | 3.3 |
| | 23.5 | 9.53 | 2.32 | 3.2 |
| | 27.4 | 9.18 | 2.24 | 3.1 |
| 50 | 15.6 | 9.50 | 2.32 | 3.6 |
| | 18.4 | 9.77 | 2.38 | 3.4 |
| | 20.9 | 9.72 | 2.37 | 3.2 |
| | 23.5 | 9.62 | 2.34 | 3.1 |
| | 27.4 | 9.14 | 2.23 | 3.1 |

As shown in FIG. 5, the method of the present invention permits achieving an excellent volume expansion ratio. Also, it was confirmed from these results that the higher the impregnation pressure, the more the volume expansion ratio is improved when the initial water content of the tobacco material is lower.

Further, a carbon dioxide impregnation treatment was conducted as above under the conditions which permitted the highest volume expansion ratio (i.e., the impregnation pressure of 50 kg/cm$^2$ and the initial water content of the cut tobacco material of 18.4%). Then, the cut tobacco material impregnated with carbon dioxide was stored in a vacuum heat insulating vessel made of a stainless steel. After the storage for 30 minutes, the cut tobacco material was subjected to a heat-expanding treatment by using the gas stream dryer, as above. Even after the storage in the heat insulating vessel, the cut tobacco material maintained a temperature of −40° C., and the volume expansion ratio of the expanded cut tobacco material was found to be 9.68 cc/g, which was fully comparable with the volume expansion ratio of 9.77 cc/g in the case of applying the expanding treatment without the storing.

It is said in general that the tobacco material should desirably be subjected to an expanding treatment under heat as soon as the tobacco material is impregnated with carbon dioxide in order to minimize the amount of carbon dioxide evaporated off from within the tobacco tissue. However, it is seen from the above results that a sufficient expanding effect can be obtained if the tobacco tissue is impregnated with about 3% of carbon dioxide (dry weight basis) by employing a suitable coldness-holding means.

EXAMPLE 2

Water was sprayed onto a cut of a flue cured tobacco produced in Japan (symbol: ESE) to humidify to have a water content of 25%. At least 5 hours after the humidification, about 100 g by dry weight of the humidified cut tobacco was put in a metal mesh container made of stainless steel, followed by putting the metal mesh container in a pressure vessel included in an impregnation apparatus identical to that used in Example 1. Then, the pressure vessel was purged with a carbon dioxide gas for 10 seconds.

Thereafter, the vessel was pressurized with a carbon dioxide gas to 30 kg/cm$^2$, followed by spraying a liquid carbon dioxide.

Twelve seconds after the spraying, all of the three thermocouples TC1, TC2 and TC3 positioned within the cut tobacco material layer indicated the saturation temperature corresponding to the 30 kg/cm$^2$ of the carbon dioxide impregnation pressure, i.e., −4.5° C. At this stage, the supply of the liquid carbon dioxide was stopped. The amount of the supplied liquid carbon dioxide was 68 g.

Eight seconds after the supply of the liquid carbon dioxide was stopped, the pressure within the pressure vessel was released to reach atmospheric pressure in about 10 seconds.

The time required for the impregnation treatment (after the pressurization with the carbon dioxide to the completion of the release to atmospheric pressure) was about 30 seconds.

Immediately after the release of the pressure, the cut tobacco material was taken out of the pressure vessel and weighed. The weight was 143.8 g. Since the cut tobacco material weighed 112.1 g before the impregnation treatment with carbon dioxide, the cut tobacco material after the carbon dioxide impregnation retained 21.7 g of carbon dioxide. This corresponds to 22.1% of the dry weight of the cut tobacco material.

The cut tobacco material impregnated with carbon dioxide retained a columnar shape corresponding to the inner shape of the pressure vessel. However, the shaped tobacco material was readily collapsed when grasped lightly with a hand, indicating that the tobacco material was not solidified/consolidated at all.

This cut tobacco material impregnated with carbon dioxide was expanded under heat within a gas stream dryer identical to that used in Example 1. The water content of the expanded tobacco material was found to be 3.4%.

After the humidity re-adjustment, the volume expansion ratio of the expanded tobacco material was measured to obtain a value of 9.42 cc/g. The non-treated cut tobacco material exhibited a volume expansion ratio of 4.09 cc/g.

Then, the same impregnation and expanding treatments were conducted on the cut humidified tobacco material of the same lot with the holding time changed.

Table 6 shows the results. The impregnation time is also shown in Table 6.

TABLE 6

| Holding Time (Impregnation Time) | $CO_2$ Retaining Rate [%] | Volume Expansion Ratio [cc/g] |
|---|---|---|
| 8 seconds (30 seconds) | 22.1 | 9.42 |
| 38 seconds (one minute) | 20.7 | 9.34 |
| 4 minutes and 38 seconds (5 minutes | 17.2 | 9.38 |
| 7 minutes and 38 seconds (8 minutes) | 15.5 | 9.40 |
| 9 minutes and 38 seconds (10 minutes) | 14.2 | 9.37 |

As seen from the results given in Table 6, a small amount of the excess liquid carbon dioxide is collected by its own weight at the bottom portion of the pressure vessel, with the result that the $CO_2$ retaining rate tends to be lowered. However, the volume expansion ratio was kept excellent regardless of the impregnation time or the holding time. It follows that, if the tobacco material is cooled without fail by spraying a minimum required amount of a liquid carbon dioxide, a satisfactory volume expansion ratio can be achieved even with such a short impregnation time as 30 seconds.

COMPARATIVE EXAMPLE 1

A humidified cut tobacco material as used in Example 2 was impregnated with carbon dioxide based on the technique employed in the Example described in Japanese Patent Publication (Kokoku) No. 56-50830. Specifically, the humidified cut tobacco material was housed in the pressure vessel as used in Example 2. After purging the pressure vessel with a carbon dioxide gas, a liquid carbon dioxide was supplied into the pressure vessel until the liquid carbon dioxide spouted out through the pressure retaining valve V9 arranged above the pressure vessel. The time required for filling the pressure vessel with a liquid carbon dioxide, which depends on the volume of the pressure vessel, the pumping capacity and the sizes of the piping and supply valves, was found to be one minute and 30 seconds in this Comparative Example.

Then, the liquid carbon dioxide was withdrawn from the pressure vessel into the recovery tank. The withdrawal took one minute.

After completion of the continuous spout of the liquid carbon dioxide out of the pressure vessel, the valve V6 was closed. Then, after the passage of liquid dripping-off time shown in Table 7 for dripping off the liquid, the pressure within the pressure vessel was vented atmospheric pressure. The time required for the pressure release was about 10 seconds as in Example 1.

It follows that the time required for the impregnation treatment except the purging time was 2 minutes and 40 seconds in addition to the liquid dripping-off time after the liquid withdrawal.

The impregnated cut tobacco material, which was taken out, was found to have been solidified/consolidated. After strongly loosened with hands, the tobacco material was heat-expanded in a gas stream dryer under the conditions same as in Example 1. The results are shown in Table 7.

TABLE 7

| Liquid Dripping-Off Time After Liquid Withdrawal | $CO_2$ Retaining Rate [%] | Volume Expansion Ratio [cc/g] |
|---|---|---|
| None | 26.2 | 9.36 |
| 3 minutes | 24.4 | 9.12 |
| 5 minutes | 22.9 | 9.21 |

In the carbon dioxide impregnation by means of dipping in a liquid carbon dioxide, it is said that it is effective to provide a predetermined liquid dripping-off time for the liquid separation after the liquid carbon dioxide withdrawal so as to lower the carbon dioxide retaining rate and, thus, to lessen the solidification/consolidation of the cut tobacco material. However, even where a liquid dripping-off time is allotted for as much as 5 minutes after the liquid carbon dioxide withdrawal, the carbon dioxide retaining rate was barely about the same as the retaining rate in the case where the impregnation time was set at 30 seconds in Example 2. Also, the volume expansion ratio was slightly inferior to that for Example 2 in which the impregnation time was set at 30 seconds. It is considered reasonable to understand that, if the entire tobacco material is dipped in a liquid carbon dioxide, an excessive liquid carbon dioxide is present relative to the tobacco material. It follows that, even if a continuous flow of a liquid carbon dioxide is stopped, the liquid carbon dioxide remains in the clearance of the tobacco material so as to bring about the particular situation noted above. It should also be noted that, since a large amount of a solid carbon dioxide is attached to the surface of the tobacco material, heat is consumed for sublimation of the solid carbon dioxide, with the result that the expanding effect is considered to be lowered even if the cut tobacco material is instantly heated in the gas stream dryer.

EXAMPLE 3

The humidified cut tobacco material having the initial water content at which the tobacco material exhibited the highest volume expansion ratio under each of the three levels of the impregnation pressure in Example 1 was impregnated with carbon dioxide by the operation similar to that employed in Example 1. Then, the impregnated tobacco material taken out of the pressure vessel was heat-expanded by using a gas stream dryer which was different from that used in Example 1. The gas stream dryer used in this Example had an expanding pipe 20 m long. The inlet temperature of the expanding pipe was controlled at 180° C. or 260° C. On the other hand, the flow rate of the gaseous stream within the expanding pipe was set equal to that in Example 1. The results are shown in Table 8. The results obtained under the heat-expanding conditions in Example 1 are reproduced also in Table 8.

TABLE 8

| Impregnation Pressure [kg/cm$^2$] (Initial Water Content) | Gaseous Stream Drying Conditions 200° C., 2 seconds | 260° C., 2 seconds | 350° C., 1 second |
|---|---|---|---|
| 30 (23.5%) | 8.76 | 9.38 | 9.40 |
| 40 (20.9%) | 8.95 | 9.69 | 9.72 |
| 50 (18.4%) | 9.11 | 9.79 | 9.77 |

As apparent from Table 8, a volume expansion ratio substantially equal to that obtained by the expanding treatment at 350° C. for one second can be obtained by the expanding treatment at 260° C. for 2 seconds. Also, the volume expansion ratio obtained by the expanding treatment at 200° C. for 2 seconds was found to be sufficiently high, though the value was somewhat inferior to those obtained under the other expanding conditions.

EXAMPLE 4

In this Example, a blended cut tobacco material (B-3: initial water content of 25%) was expanded as in a similar manners to Example 2, using a pressure vessel having an inner volume of lOL (diameter of 200 mm and depth of 320 mm).

Specifically, about 1250 g (1000 g on the dry weight) of the blended cut tobacco material was loaded in the pressure vessel, followed by pressuring the vessel with a carbon dioxide gas to 30 kg/cm$^2$, and subsequently spraying 790 g of a liquid carbon dioxide onto the tobacco material. The amount of the liquid carbon dioxide supplied corresponds to 79% of the blended cut tobacco material on the dry weight basis.

The pressurization with the carbon dioxide gas to the above-noted impregnation pressure and the spraying of the liquid carbon dioxide were conducted in one minute. One minute after completion of the liquid carbon dioxide supply, the three thermocouples TC1 to TC3 arranged within the blended cut tobacco material layer all indicated the saturation temperature (−4.5° C.).

After passage of the holding time of 0 minute (none), 3 minutes, or 8 minutes, the pressure within the pressure vessel was vented to atmospheric pressure in about 30 minutes.

Then, the blended cut tobacco material taken out was passed through a cut tobacco-loosening device comprising a pair of rollers each having a plurality of pins 30 mm long erected thereon, followed by heat-expanding the material in a gas stream dryer under the same conditions as in Example 1. Table 9 shows the results.

COMPARATIVE EXAMPLE 2

A blended cut tobacco material was dipped in a liquid carbon dioxide and the subsequent treatments were carried out as in Comparative Example 1, using the pressure vessel used in Example 4.

In this Comparative Example 2, 8 minutes were required for dipping the blended tobacco material in the liquid carbon dioxide, and 2 minutes were required for withdrawing the liquid carbon dioxide.

Then, immediately, 3 minutes or 8 minutes after the liquid carbon dioxide separation, the pressure within the pressure vessel was released to reach atmospheric pressure in about 30 minutes.

The blended tobacco material taken out was passed through the loosening device used in Example 4, followed by heat-expanding the material under the same conditions as in Example 4 using a similar gas stream dryer.

Table 9 also shows the results. The term "lapse of time" given in Table 9 denotes the holding time for Example 4 and the liquid dripping-off time for Comparative Example 2.

TABLE 9

| Lapse of Time [min.] | $CO_2$ Retaining Rate [%] Ex. 4 | Com. Ex. 2 | Volume Expansion Ratio [cc/g] Ex. 4 | Com. Ex. 2 |
|---|---|---|---|---|
| None | 14.2 | 43.8 | 8.96 | 8.89 |
| 3 minutes | 10.4 | 32.1 | 8.85 | 8.78 |
| 8 minutes | 8.0 | 27.7 | 8.99 | 8.81 |

An extra carbon dioxide is scarcely used in the method of the present invention in which a liquid carbon dioxide is sprayed onto a tobacco material. Therefore, the method of the present invention permits shortening the impregnation time, compared with the conventional method in which the tobacco material is dipped in a liquid carbon dioxide, regardless of the scale of the apparatus, as apparent from Table 9. If the impregnation time is shortened, the amount of the tobacco material processed per unit time can be increased, or the processing apparatus can be miniaturized.

Further, in the case of using a pressure vessel having a large inner volume, a difference in carbon dioxide retaining rate is enlarged between the method of the present invention in which a liquid carbon dioxide is sprayed onto a tobacco material and the conventional method in which a tobacco material is dipped in a liquid carbon dioxide (see Table 9). In the conventional dipping method, a considerably large amount of an extra carbon dioxide remains in the tobacco material. Specifically, even 8 minute dripping-off time was taken, the carbon dioxide retaining rate was as high as about 28%. The lower half portion of the cut tobacco material taken out of the pressure vessel was found to have been firmly solidified/consolidated. Since the solidified portion was not collapsed even if grasped with a hand, it was necessary to loosen the solidified tobacco material by using the loosening device. The presence of an extra carbon dioxide which causes the cut tobacco material to be firmly solidified/consolidated is undesirable because it is difficult to recover the extra carbon dioxide and because the extra carbon dioxide possibly gives detrimental effects to the environment and the producing cost of the tobacco article.

On the other hand, in the method of the present invention in which a liquid carbon dioxide is sprayed onto a tobacco material, a predetermined minimum required amount of carbon dioxide is effectively used, with the result that the processed tobacco material scarcely contains an extra carbon dioxide. Naturally, the cut tobacco material taken out of the pressure vessel is not firmly solidified/consolidated but is in a loosened state. As a matter of fact, the cut tobacco material taken out of the pressure vessel passed substantially smoothly through the loosening device.

The expanded tobacco material for each of Example 4 and Comparative Example 2 was sieved after 8 minutes of the holding time. The sieving machine used was PRUEFSIB JEL 200 type manufactured by JEL (J. Engelsmann AG) in Germany. Sieves having open mesh sizes of 4.00 mm, 3.15 mm, 2.00 mm, 1.00 mm and 0.50 mm defined by International Standardization Organization (ISO) and Japanese Industrial Standards (JIS) were stacked one upon the other in the sieving machine.

In sieving the tobacco material, the expanded cut tobacco material was sufficiently mixed and, then, subjected to reduction to take out 25 g of a sample. The sample was kept disposed on the stacked sieves for 2 minutes, followed by precisely weighing the tobacco material left on each of the sieves and the tobacco material passing through the lowermost sieve having the open mesh size of 0.50 mm. The percentage of the weighed tobacco material relative to the initial weight of the cut tobacco material (25 g). The weighing was performed 8 times for each sample, and the average value was obtained. The results are shown in Table 10.

TABLE 10

| | 4 mm or more | Less than 4 mm to 3.15 mm | Less than 3.15 mm to 2 mm | Less than 2 mm to 1 mm | Less than 1 mm to 0.5 mm | Less than 0.50 mm |
|---|---|---|---|---|---|---|
| Example 4 | 10.2 | 9.4 | 29.4 | 40.0 | 7.6 | 3.4 |
| Com. Ex. 2 | 3.1 | 4.0 | 19.2 | 53.0 | 15.6 | 5.1 |

If the cut tobacco material is firmly solidified/consolidated, the tobacco material is broken when the solidified tobacco material is loosened. Fine tobacco material (fine powder), which passes through a sieve having an open mesh size of 1 mm, is unsuitable for the manufacture of cigarettes, lowering the yield of the cigarettes.

As apparent from Table 10, in the conventional method in which the tobacco material is dipped in a liquid carbon dioxide, the impregnated tobacco material severely solidified, and, as a result, the tobacco material is markedly broken in loosening the solidified tobacco material. It follows that the length of the cut pieces of the tobacco material is made smaller as a whole, compared with those obtained by the method of the present invention in which a liquid carbon dioxide is sprayed onto the tobacco material. Particularly, the amount of the cut pieces of the tobacco material which passed through the sieve having an open mesh size of 1 mm exceeded 20%.

On the other hand, in the method of the present invention in which a liquid carbon dioxide is sprayed onto the tobacco material, almost all the tobacco material after the impregnation treatment passed smoothly through the loosening device. Naturally, breakage of the impregnated tobacco material was suppressed, with the result that the amount of fine pieces of the cut tobacco material which passed through the sieve having an open mesh size of 1 mm was only 11%, which was half the value for the conventional dipping method.

After the sieving, the remainder of each expanded tobacco material was made into cigarettes. The resultant cigarettes were used for comparative tests for the tasting quality without clarifying the producing method. The tasting quality for the spraying method of the present invention was found to be +2 based on the tasting quality of 0 for the conventional dipping method, indicating that the cigarette prepared by using the method of the present invention is clearly superior in the tasting quality to the cigarette prepared by using the conventional method. It should be noted in particular that, in the conventional dipping method, the volatile components of the tobacco material are dissolved in the liquid carbon dioxide. As a result, the flavor is released from the tobacco material, leading to the poor tasting quality.

As described above, the method of the present invention makes it possible to impregnate a tobacco material with carbon dioxide in a short time by using a minimum required amount of carbon dioxide. In addition, an expanded tobacco material of a high quality can be manufactured in the present invention by using an apparatus of a simple construction.

What is claimed is:

1. A method of producing an expanded tobacco material, comprising the steps of:

(a) feeding a tobacco material into a pressure vessel;

(b) pressuring the interior of said pressure vessel with a carbon dioxide gas to an impregnation pressure of at least about 4.3 kg/cm$^2$ in gage pressure;

(c) supplying a liquid carbon dioxide from above the tobacco material while maintaining said impregnation pressure so as to saturate interior of said pressure vessel with a carbon dioxide gas by the vaporization of said liquid carbon dioxide;

(d) decreasing the pressure within the pressure vessel to substantially atmospheric pressure after the state within the vessel is held for a predetermined time;

(e) taking the tobacco material out of said pressure vessel;

(f) supplying the tobacco material taken out of the pressure vessel into a gaseous stream dryer so as to expand the tobacco material by bringing the tobacco material into contact with a high temperature gaseous stream within said gaseous stream dryer; and (g) separating the expanded tobacco material from said high temperature gaseous stream.

2. The method according to claim 1, wherein the tobacco material in said step (a) has a water content of 12 to 33% on a dry weight basis.

3. The method according to claim 1, wherein the tobacco material in said step (a) is at a temperature of 20° C. to 30° C.

4. The method according to claim 1, wherein the impregnation pressure in said step (b) is 10 to 74 kg/cm$^2$ in gage pressure.

5. The method according to claim 4, wherein the impregnation pressure in said step (b) is 30 to 60 kg/cm$^2$ in gage pressure.

6. The method according to claim 1, wherein a tobacco material whose water content is decreased with increase in the impregnation pressure in said step (b) is used in said step (a).

7. The method according to claim 1, wherein a supply amount of said liquid carbon dioxide in said step (c) is 0.04 to about 2.4 times as much as the weight of the tobacco material on dry weight basis.

8. The method according to claim 7, wherein the supply amount of said liquid carbon dioxide in said step (c) is 0.06 to about 1.4 times as much as the weight of the tobacco material on dry weight basis.

9. The method according to claim 1, wherein supply of the liquid carbon dioxide in said step (c) is stopped immediately after the temperature of the tobacco material has reached saturation temperature of the carbon dioxide gas at said impregnation pressure.

10. The method according to claim 1, wherein supply of the liquid carbon dioxide in said step (c) is stopped at a time when the liquid carbon dioxide flows slightly out of a bottom portion of the pressure vessel.

11. The method according to claim 1, wherein said predetermined time in said step (d) is at least 10 seconds.

12. The method according to claim 1, wherein said high temperature gaseous stream in said step (f) contains steam and is at a temperature of 260° C. to 350° C.

13. The method according to claim 12, wherein the tobacco material is kept in contact with said high temperature gaseous stream in said step (f) for 1 to 2 seconds.

14. The method according to claim 1, wherein the tobacco material is expanded in said step (f) until the water content of the tobacco material is lowered to 8% or less on a dry weight basis.

15. A method of producing an expanded tobacco material, comprising the steps of:

(a) feeding a tobacco material at a first temperature into a pressure vessel;

(b) pressurizing the interior of said pressure vessel to an impregnation pressure which is lower than the saturation pressure of carbon dioxide gas at said first temperature;

(c) supplying a liquid carbon dioxide from above the tobacco material housed in the pressure vessel in a minimum amount required for cooling the tobacco material to a second temperature corresponding to the saturation temperature of the carbon dioxide gas at said impregnation pressure to bring said liquid carbon dioxide into contact with the tobacco material, thereby cooling the tobacco material to said second temperature by latent heat of vaporization of said liquid carbon dioxide and impregnating the tobacco material with carbon dioxide;

(d) taking the tobacco material impregnated with carbon dioxide out of the pressure vessel; and (e) expanding under heat the tobacco material taken out of the pressure vessel.

16. The method according to claim 15, wherein said first temperature in said step (a) is 20° C. to 30° C.

17. The method according to claim 15, wherein the tobacco material in said step (a) has a water content of 12% to 25% on dry weight basis.

18. The method according to claim 15, wherein the impregnation pressure in said step (b) is not lower than the pressure at a triple point, but lower than the pressure at a critical point.

19. The method according to claim 18, wherein the impregnation pressure in said step (b) falls within a range of between 10 and 74 kg/cm$^2$ in gage pressure.

20. The method according to claim 15, wherein a tobacco material whose water content is decreased with increase in the impregnation pressure in said step (b) is used in said step (a).

21. The method according to claim 15, wherein the supply amount of the liquid carbon dioxide in said step (c) is 1 to about 7 times as much as the theoretical amount.

22. The method according to claim 21, where the supply amount of the liquid carbon dioxide in said step (c) is 1.5 to about 4 times as much as the amount theoretically required to raise the temperature of the tobacco material contained in the pressure vessel to a temperature corresponding to the temperature of the saturated carbon dioxide gas.

23. The method according to claim 15, wherein the supply of the liquid carbon dioxide is stopped in said step (c) immediately after the temperature of the tobacco material has reached said second temperature.

24. The method according to claim 15, wherein the supply of the liquid carbon dioxide is stopped in said step (c) at a time when the liquid carbon dioxide flows only slightly out of the bottom portion of the pressure vessel.

25. The method according to claim 15, wherein the tobacco material impregnated with carbon dioxide contains steam and is brought into contact in said step (e) with a gaseous stream having a temperature of 260° C. to 350° C.

26. The method according to claim 25, wherein the tobacco material impregnated with carbon dioxide is kept in contact in said step (e) with a gaseous stream for 1 to 2 seconds.

27. The method according to claim 15, herein the tobacco material is expanded in said step (e) until the water content of the tobacco material is decreased to at most 8% on a dry weight basis.

* * * * *